US006139658A

United States Patent [19]

Davies et al.

[11] Patent Number: 6,139,658

[45] **Date of Patent: *Oct. 31, 2000**

[54] METAL MATRIX ALLOYS

[75] Inventors: Peter Davies, Herringthorpe; James Leslie Frederick Kellie, Bamford; Richard Nigel McKay, Wadsley; John Vivian Wood, Bolnhurst, all of United Kingdom

[73] Assignee: London & Scandinavian Metallurgical Co., Ltd., United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,447

[22] Filed: Sep. 23, 1997

Related U.S. Application Data

[63] Continuation of application No. 08/633,348, Apr. 17, 1997, abandoned, which is a continuation of application No. 08/467,929, Jun. 6, 1995, abandoned, which is a continuation of application No. 08/302,095, Sep. 7, 1994, abandoned, which is a continuation of application No. 07/915,301, Jul. 20, 1992, abandoned.

[30] Foreign Application Priority Data

Jul. 26, 1991 [GB] United Kingdom ..... 9116174

[51] Int. Cl.[7] ..... C21D 1/18

[52] U.S. Cl. ..... 148/515; 75/351; 75/368; 75/959

[58] Field of Search ..... 148/400, 405, 148/515; 420/120, 417; 75/351, 368, 959

[56] References Cited

U.S. PATENT DOCUMENTS

| | | | |
|---|---|---|---|
| 2,828,202 | 3/1958 | Goetzel et al. | 420/417 |
| 4,161,512 | 7/1979 | Merzhanov et al. | 423/440 |
| 4,687,511 | 8/1987 | Paliwal et al. | 420/590 |
| 4,853,182 | 8/1989 | Cornie et al. | 420/129 |
| 4,909,842 | 3/1990 | Dunmead et al. | 75/236 |
| 4,915,908 | 4/1990 | Nagle et al. | 420/590 |
| 4,921,531 | 5/1990 | Nagle et al. | 75/351 |
| 5,053,192 | 10/1991 | Merzhanov et al. | 419/10 |

FOREIGN PATENT DOCUMENTS

| | | | |
|---|---|---|---|
| 0419685 | 12/1988 | European Pat. Off. | C22C 1/05 |
| 2151936 | 4/1973 | France | C22C 33/00 |
| 1305721 | 2/1973 | United Kingdom . | |
| 1352285 | 5/1974 | United Kingdom . | |
| 1431882 | 4/1976 | United Kingdom . | |
| WO8803573 | 5/1988 | WIPO | C22C 1/05 |

OTHER PUBLICATIONS

*Documents were submitted by applicants.

*Primary Examiner*—Sikyin Ip
*Attorney, Agent, or Firm*—Fish & Neave; Jeffrey H. Ingerman; Eric H. Huang

[57] ABSTRACT

The invention provides a method of making a titanium carbide metal matrix alloy, by firing a particulate reaction mixture comprising carbon, titanium and matrix material, under conditions such that the titanium and carbon react exothermically to form a dispersion of fine particles comprising titanium carbide (preferably less than 10 microns) in a predominantly metal matrix. The titanium and matrix are preferably added as a titanium alloy such as ferrotitanium, e.g. eutectic ferrotitanium. The reaction conditions are preferably selected so that during the reaction a molten zone moves through the body of the reaction mixture; the resulting hard particles are of globular form; and their average size is uniform throughout the resulting dispersion.

21 Claims, 5 Drawing Sheets

METAL MATRIX ALLOYS

This application is a continuation of application No. 08/633,348, filed Apr. 17, 1997, now abandoned, which is a continuation of application No. 08/467,929, filed Jun. 6, 1995, now abandoned, which is a continuation of application No. 08/302,095, filed Sep. 7, 1994, now abandoned, which is a continuation of application No. 07/915,301, filed on Jul. 20, 1992, abandoned.

BACKGROUND OF THE INVENTION

1. The Field of the Invention

This invention relates to a method of making an alloy comprising hard particles comprising titanium carbide dispersed in a predominantly metal matrix, and to the resulting alloy itself.

Alloys of the aforementioned kind are hereinafter referred to as titanium carbide metal matrix alloys; as known hitherto they are generally in the form of a high concentration of titanium carbide particles dispersed in a metal matrix such as ion.

2. Description of the Related Art

Titanium carbide metal matrix alloys are used in, for example, the following applications:

(i) Hard Facing

A hard, wear-resisting layer of the alloy is applied to a substrate metal, by depositing it from a thermal spray powder comprising the metal matrix alloy in powder form, or from a welding electrode made from the metal matrix alloy.

(ii) As an Alloying Component

Titanium carbide particles are introduced into an alloy melt by adding the metal matrix alloy, either in bulk (e.g. lump) form, or by feeding in a cored wire containing the metal matrix alloy in powder form.

(iii) As a Powder Metallurgical Product

Hard composite products are made by powder metallurgical techniques from a mixture of powdered titanium carbide and a powdered metal or alloy which is to serve as the matrix in the product.

The following methods may be used for making titanium carbide metal matrix alloys:

(a) Vacuum Carburization

Fine powders of titanium dioxide and carbon are thoroughly mixed and then reacted at high temperature in a vacuum induction furnace. The resulting titanium carbide is then cooled, comminuted, and mixed with the matrix material, and is subsequently formed into a composite product by a powder metallurgical technique. This method is used industrially.

Although the titanium carbide produced by the carburization step can be of high purity, the vacuum induction process is expensive, and the comminution step can result in the introduction of undesirable impurities on the surfaces of the titanium carbide particles.

(b) Carburization within the Metal Matrix

It is known that if one forms a high carbon ferrous melt containing one or more carburizable alloying metals such as titanium, the respective carbide(s) can be precipitated. While held in the melt, those particles can grow to an undesirable extent, especially when the carbide concentration is high.

European Patent Specification No. 0212435 Al suggests a method of making carbide master alloys involving carburizing ferroalloys in the solid state, with the intention that the resulting carbide particles should be fine. Details of the carburisation process are not given.

(c) Direct Carburization of Titanium Powder

This method has been used industrially. It involves reacting a mixture of powders of titanium metal and carbon. The resulting product is a sintered titanium carbide mass, which has to be broken down to a fine particle size, and then mixed with metal matrix powder, to be formed powder metallurgically into a metal matrix composite product. Powdering the sintered titanium carbide mass to the required degree is difficult, and leads to the titanium carbide picking up impurities. Also, the titanium powder reactant is expensive.

SUMMARY OF THE INVENTION

It will therefore be appreciated that there is a need to provide a method of making a titanium carbide metal matrix alloy which provides, at acceptable cost, an alloy comprising a fine dispersion of hard particles comprising titanium carbide in a predominantly metal matrix.

According to the present invention, there is provided a method of making an alloy comprising hard particles comprising titanium carbide dispersed in a predominantly metal matrix, the method comprising firing a particulate reaction mixture comprising carbon, titanium and matrix material, under conditions such that the titanium and carbon react exothermically to form a dispersion of fine particles comprising titanium carbide in a predominantly metal matrix.

DESCRIPTION OF THE PREFERRED EMBODIMENTS

It is surprising that the exothermic reaction of the method of the invention is capable of producing a dispersion of fine, hard particles in the matrix. However, we have found that it is possible, using simple trial and error experiments, to find suitable conditions to achieve that end, when the following principles are borne in mind:

(i) It is highly desirable to adjust the reaction conditions such that the exothermic reaction is carried out under conditions such that during the reaction a molten zone moves through the body of the reaction mixture, so that at a given point during reaction the reaction mixture ahead of the reaction zone is solid, and so is that behind the reaction zone.

(ii) The hard particles preferably should be of generally globular shape. That indicates that the reaction zone has reached a sufficiently high temperature to allow precipitation of the hard particles. However, in less preferred embodiments of the invention, at least some of the hard particles may be of angular shape, and indeed they may all be thus shaped.

(iii) In order to promote uniformity of reaction conditions, and thus also uniformity of the physical properties of the product, the bulk of the reaction mixture should not be too small (unlikely to occur in practice or too large. Success in this regard can readily be assessed by observing the uniformity of the particle size of the hard particles formed throughout the reaction mixture. Preferably, the average particle size of the hard particles is substantially uniform throughout the resulting dispersion.

(iv) The longer the hard particles are present in a melt before solidification, the larger their final size will be. If the hard particles are found to be undesirably large through being present in a melt for too long a time, the process conditions can be adjusted so that the temperature reached in the reaction is decreased and/or the cooling rate is increased.

(v) The temperature reached in the exothermic reaction can be decreased by one or more of the following measures:

(a) decreasing the concentration of the reactants, e.g. by increasing the concentration of matrix material;

(b) increasing the particle size of the reactants; and (c) decreasing the weight of the reaction mixture.

(d) replacing a part of the titanium reactant by an additional carbide-forming reactant which reacts with the carbon less exothermically than does the titanium reactant.

The temperature can, of course, be increased by reversing one or more of (a), (b), (c) and (d).

It will be appreciated that in the method of the invention, the particulate reaction mixture which is fired may include reactable materials in addition to the carbon and titanium, which additional reactable materials may be present in the matrix material or otherwise; for example chromium, tungsten, vanadium, niobium, boron ad/or nitrogen. The resulting fine particles comprising titanium carbide will therefore not necessarily consist of titanium carbide as such. Thus, for example, where nitrogen is present, they may comprise carbonitride; or where tungsten is present, they may comprise tungsten titanium carbide.

Desirably, the available titanium content of the reaction mixture is equal to at least 30% by weight, and preferably greater than 50% and less than 70% by weight, of the total weight of the reaction mixture (the term "reaction mixture" as used herein means the total of all the materials present in the reaction body, including any which do not undergo any chemical reaction in the method of the invention and which may in effect be a diluent). This will generally enable sufficient heat to be generated in the exothermic reaction, and a useful concentration of hard particles to be formed in the product.

We prefer that the carbon should be present in the reaction mixture as carbon black.

The matrix metal may be based on iron (preferably), nickel, cobalt or copper, for example. We prefer that the titanium should be present in the reaction mixture as an alloy of matrix metal and titanium. Where the product alloy is to be iron-based, we prefer that the titanium should be present in the reaction mixture as ferrotitanium, and most preferably as eutectic ferrotitanium, which contains about 70% by weight titanium. In the latter case, we have found that a suitable particle size for the eutectic ferrotitanium is generally in the range 0.5 mm down to 3.0 mm down.

Where the product alloy is to have a matrix metal based on nickel, cobalt or copper, we prefer that the titanium should be present in the reaction mixture as an alloy comprising, respectively, nickel and titanium, cobalt and titanium, or copper and titanium.

We have discovered that the usefulness of the product alloy for some end uses can be considerably enhanced by including tungsten in the reaction mixture. Thus, where the product alloy is to be added to a metal melt which is similar to the matrix metal of the product alloy, we have discovered that where tungsten has been included in the reaction mixture there is usually an improvement, to a surprising degree, in the uniformity with which the product alloy becomes dispersed in the metal melt. We believe that this is because the presence of tungsten in the product alloy increases its density. Accordingly, for such applications, the amount of tungsten included should be tailored in accordance with the density of the metal melt to which the product alloy is to be added, and generally so as substantially to match it. Thus, for example, the density of steel is about 7.7 $gcm^{-3}$ and that of iron is about 7.2 $gcm^{-3}$. We have found that where the product material is to be added to an iron-based melt, it is desirable for the matrix material to comprise iron, and that tungsten should be included in the reaction mixture in an amount such that the density of the product, as measured by a pycnometer, is from 6.0 to 7.9 $gcm^{-3}$, preferably from 7.0 to 7.9 $gcm^{-3}$; the latter density should be tailored in accordance with that of the specific iron-based melt to which the product alloy is to be added. The tungsten can be added as tungsten metal or as ferrotungsten, for example. It could be useful to add, as an addition or alternative to the tungsten, one or more other relatively dense materials such as molybdenum (which could be added as molybdenum metal or ferromolybdenum, for example) so as to increase the density of the product alloy; preferably the added heavy material is such that it becomes incorporated in the titanium carbide, as does tungsten. We expect that principles similar to those described in this paragraph can be applied to increase the density where the product material is to be added to a nickel-, cobalt- or copper-based melt, for example.

In some instances, for example where the concentration of titanium in the reaction mixture is particularly low, the reaction mixture may need to be pre-heated in order to get it to fire and react without further heat input. However, we prefer that the temperature of the body of the reaction mixture should be at less than 600° C., and preferably at less than 500° C., immediately prior to firing.

We most prefer that the temperature of the body of the particulate reaction mixture is substantially at ambient temperature (i.e. at no more than 100° C.) immediately prior to firing. Where a particular reaction mixture will not fire at ambient temperature, it may be modified, using the principles described above, so that it can be fired at ambient temperature and react without requiring further heat input.

Preferably the particulate reaction mixture which is fired is a loose mixture (i.e. a mixture which, although it may have been packed, has not been compressed to such an extent as to cause it to become fully cohesive, as occurs in briquetting). We have found that briquetting of the reaction mixture very much reduces its ability to be fired so as to produce a self-sustaining reaction.

The firing of the particulate reaction mixture in the method according to the invention may be performed in any suitable manner. For example, an ignitable firing material (e.g. titanium particles) may be positioned at the surface of the particulate reaction mixture and sufficient heat applied to the ignitable material to cause ignition. Alternatively, the particulate reaction mixture may be fired by heating in such a way that an outer skin of the particulate reaction mixture is heated to a high temperature, sufficient to initiate the exothermic reaction, the body of the particulate reaction mixture having undergone relatively little heating at that stage; this can be achieved by, for example, heating the particulate reaction mixture in a heat-inducing (e.g. clay graphite or silicon carbide) crucible, in a coreless induction furnace.

For most end uses of the product, we prefer that the amount of carbon in the reaction mixture should be substantially the stoichiometric amount required to react with all of the available titanium in the reaction mixture. However, we have found that where the matrix material comprises iron, the usefulness of the product alloy for some end uses can be enhanced to a surprising degree if the amount of carbon in the reaction mixture is in an excess of the stoichiometric amount required to react with all of the available titanium in the reaction mixture, such that the composition of the matrix metal in the product alloy approximates that of cast iron. Thus, where the product alloy is to be used as an addition to a cast iron-based melt, we have discovered that the compatibility of the product with the iron-based melt is then enhanced, to a surprising degree.

We have found that by practising the invention taking into account the points discussed above, it is easily possible to arrange that the average particle size of the hard particles in the product is less than 25 microns, and an average particle size of less than 10 microns can be achieved without difficulty.

In accordance with a preferred embodiment, the method of the invention comprises firing a reaction mixture comprising carbon black and crushed eutectic ferrotitanium under conditions such that a molten zone moves through the body of the reaction mixture, to form a dispersion of generally globular titanium carbide particles of average particle size less than 10 microns in a ferrous metal matrix.

For many end uses it is desirable to reduce the dispersion produced by the method of the invention to a powder; one having an average particle size of less than 250 microns is preferred.

BRIEF DESCRIPTION OF THE DRAWINGS

In order that the invention may be more fully understood, some preferred embodiments in accordance therewith will now be described in the following Examples, with reference to the accompanying drawings wherein.

EXAMPLE 1

20 kg of eutectic ferrotitanium (70% titanium, by weight) produced by London & Scandinavian Metallurgical Co Limited were crushed to less than 2 mm and mixed with 3.5 kg of Meteor LUV carbon black. The mixture was loosely packed into a steel lined reaction vessel; a refractory lined vessel would have been an adequate alternative. The mixture was ignited by forming a depression in its top surface, which was filled with titanium grindings, to which a flame was applied. Once ignited, an exothermic reaction propagated throughout the whole of the powder bed, such that, at a given point during the reaction the reaction mixture ahead of the reaction zone was solid, the reaction zone itself was liquid and the reacted material behind the reaction zone was solid.

Figure 1:
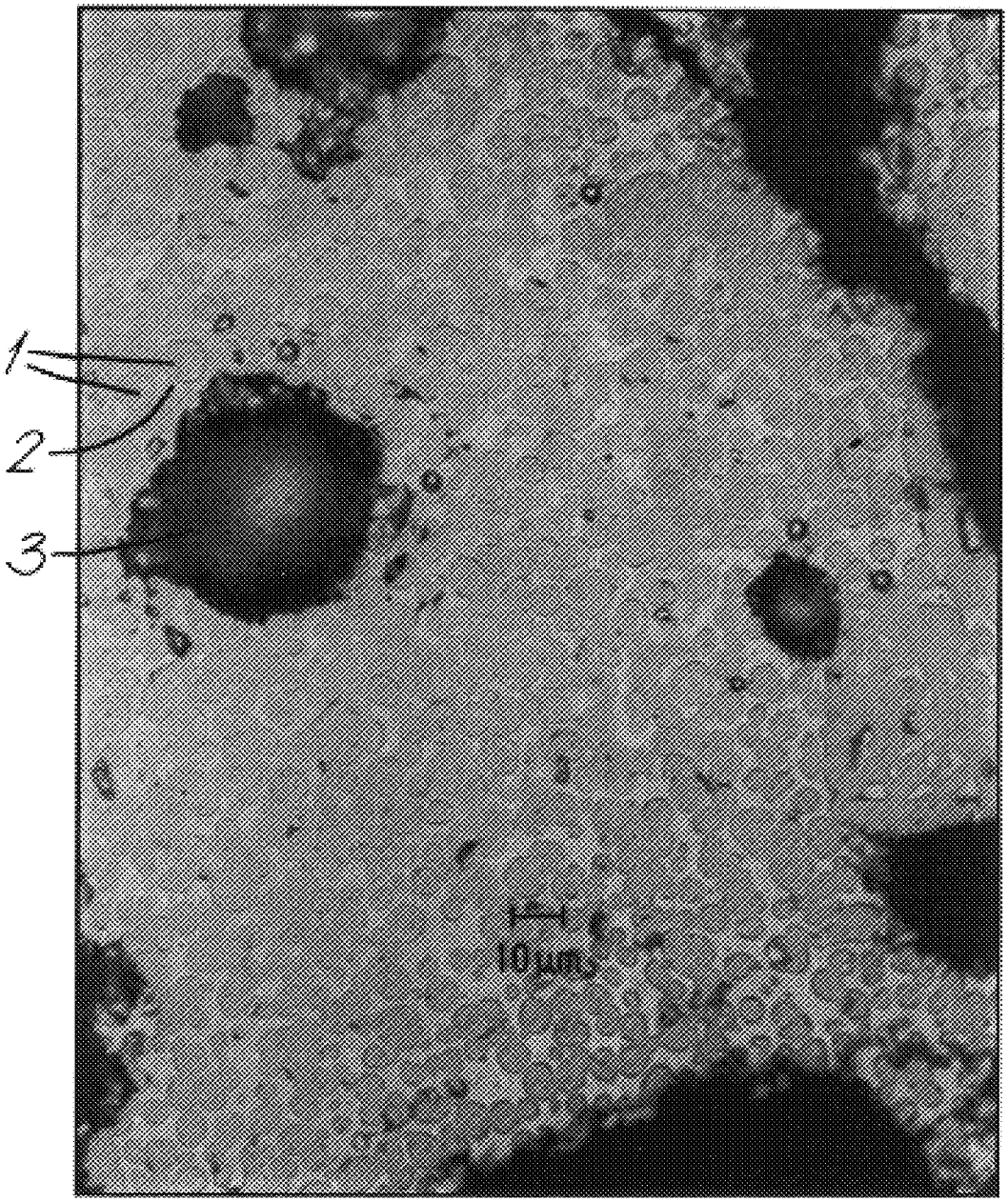
FIG. 1 shows a photomicrograph, at a magnification of 500, of the alloy produced in Example 1.

The product was alloyed to cool and then crushed to a powder less than 150 microns. FIG. 1 is a photomicrograph of the product, and shows that it consists of a uniform dispersion of fine TiC grains 1 in a steel matrix 2; the dark patches as at 3, for example, are areas of porosity. As can be readily seen, the TiC grains 1 are of globular form, and the majority are below 10 microns in size. The density of the product was 5.21 $gcm^{-3}$.

In two tests attempts were made to repeat the foregoing Example, with the sole difference that the particle size of the eutectic ferrotitanium used was 5 mm down and 300 microns down, respectively. With the former, it was found that the mixture would not fire. With the latter, the reaction was very vigorous, and the titanium carbide particles in the product were relatively large.

EXAMPLE 3

18 kg of eutectic ferrotitanium (70% titanium by weight) produced by London & Scandinavian Metallurgical Co Limited were crushed to less than 2 mm and mixed with 13 kg of pure tungsten metal powder 1 to 1.3 microns in size and 3.9 kg of Meteor LUV carbon black. The mixture was loosely packed into a clay graphite crucible. The crucible was then heated using a coreless induction furnace until the outer skin of the particulate reaction mixture in contact with the crucible was at about 1100° C. and the bulk of that mixture was still at about ambient temperature; the outer skin ignited at this point. Once ignited an exothermic reaction propagated throughout the whole of the powder bed, without further heat input, such that, at a given point during the reaction, the reaction mixture ahead of the reaction zone was solid, the reaction zone itself was liquid and the reacted material behind the reaction zone was solid.

Figure 2:
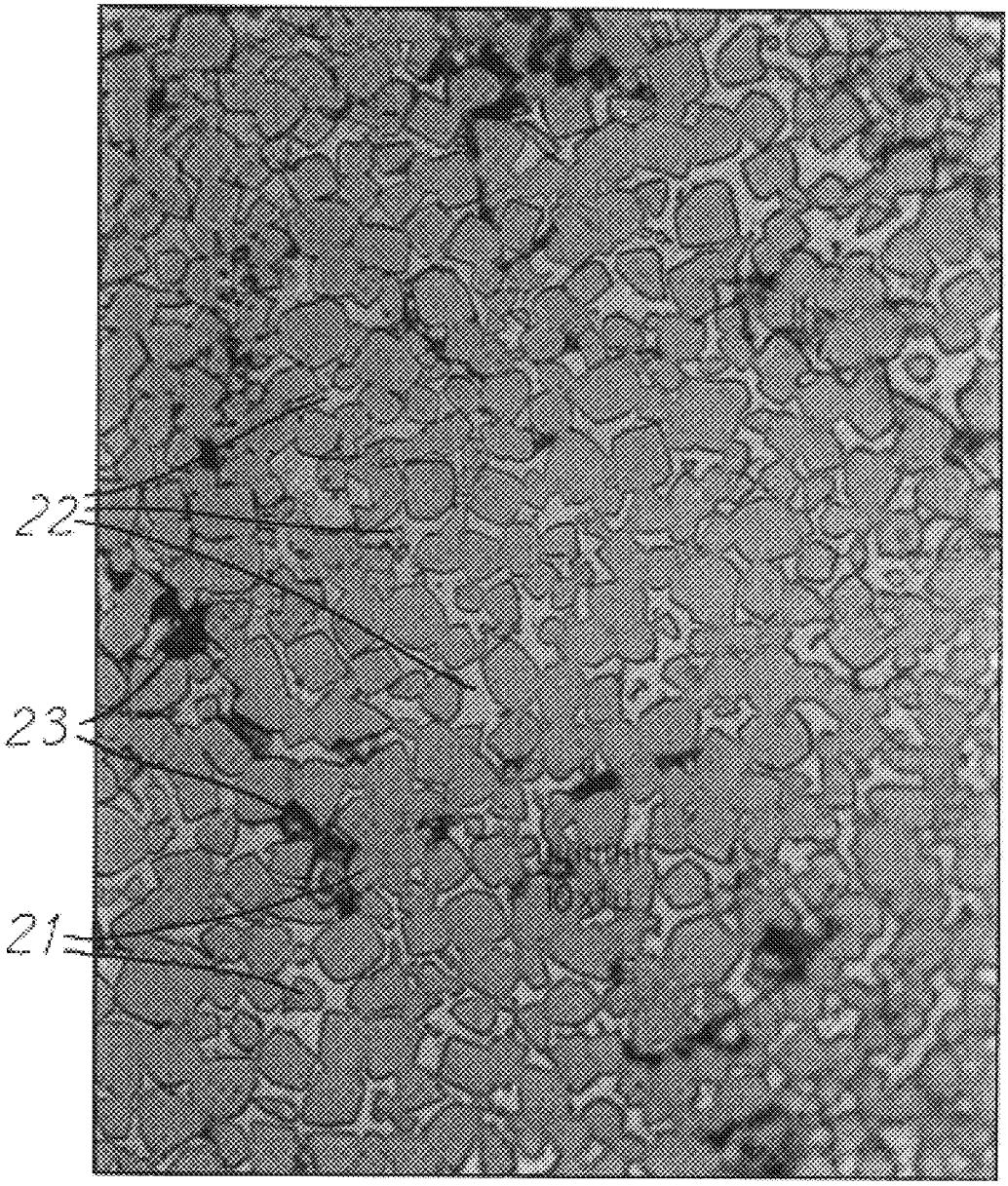
FIG. 2 shows a photomicrograph, at a magnification of 1000, of the alloy produced in Example 2.

The product was allowed to cool and crushed to a lump of less than 15 mm. FIG. 2 is a photomicrograph of the product, and shows that it consists of a uniform dispersion of fine WTiC particles 21 where the tungsten and titanium are in solid solution within a steel matrix 22; the dark patches as at 23, for example, are areas of porosity. As can be readily seen the WTiC particles are of globular form, and the majority are below 20 microns in size. The density of the product was 7.36 $gcm^{-3}$, which was a good match for that of cast iron (about 7.2 $gcm^{-3}$).

If an appropriate excess of carbon had been added to the original reaction mixture, the matrix in the product would have been iron rich in carbon, i.e. it would have been similar to cast iron.

EXAMPLE 3

100 grams of an alloy comprising 60% titanium and 40% copper, by weight, were crushed to less than 500 microns in size and mixed with 1.41 grams of Meteor LUV carbon black. The mixture was loosely packed into a refractory lined reaction vessel; a steel lined vessel would have been an adequate alternative. The mixture was heated to 400° C. before being ignited by forming a depression in its top surface, which was filled with fine titanium sponge, to which a flame was applied. Once ignited, an exothermic reaction propagated throughout the whole of the powder bed, without further heat input, such that, at a given point during the reaction the reaction mixture ahead of the reaction zone was solid, the reaction zone itself was liquid and the reacted material behind the reaction zone was solid.

Figure 3:
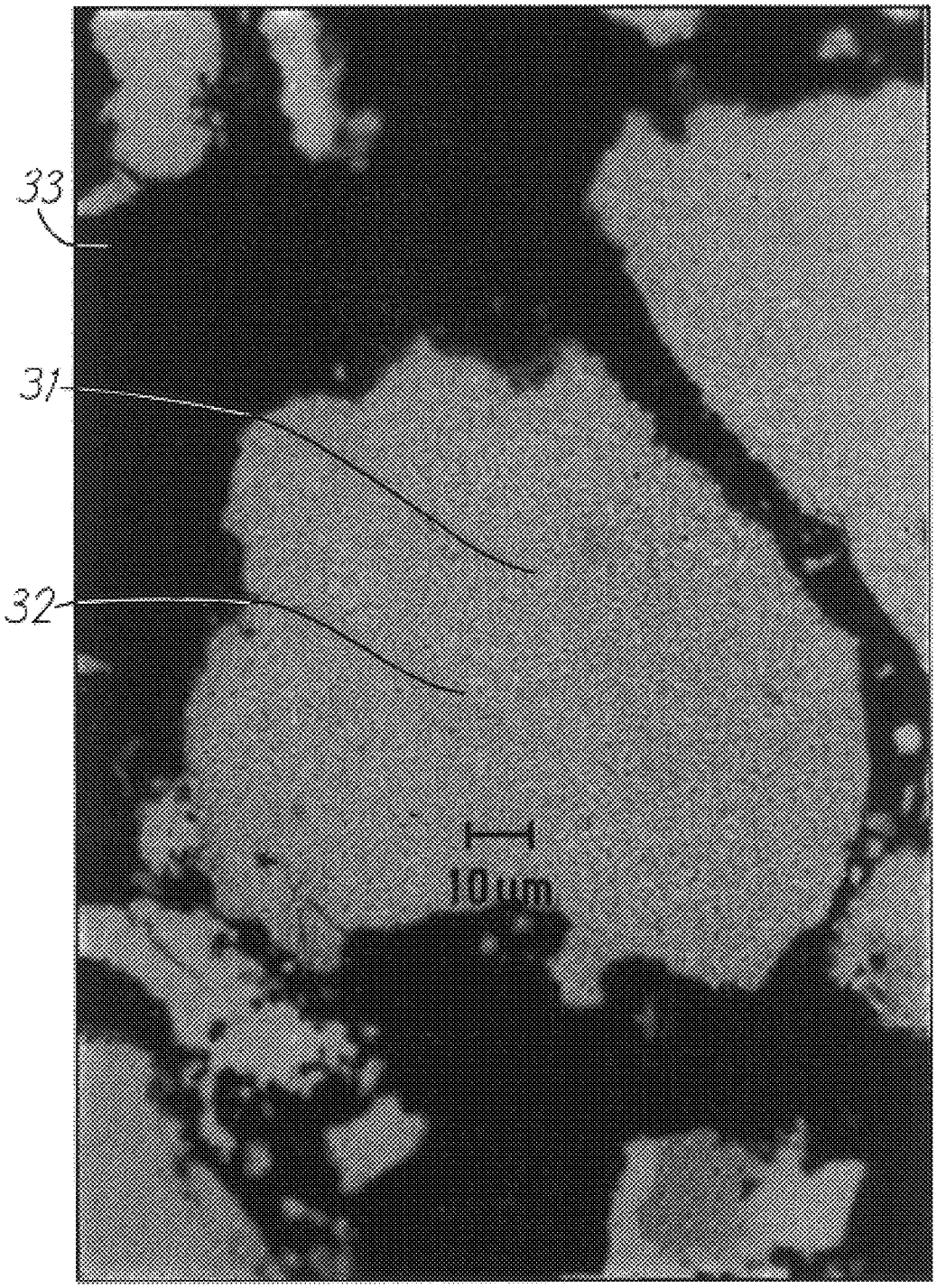
FIG. 3 shows a photomicrograph, at a magnification of 750, of the alloy produced in Example 3.

The product was allowed to cool and then crushed to a powder less than 150 microns. FIG. 3 is a photomicrograph of the product, and shows that it consists of a uniform dispersion of fine TiC grains 31 in a copper matrix 32; the dark patches as at 33, for example, are voids. As can be readily seen, the TiC grains 31 are of acicular form, and the majority are below 10 microns in size.

EXAMPLE 4

100 grams of an alloy comprising 70% titanium and 30% nickel, by weight, were crushed to less than 500 microns in size and mixed with 16.4 grams of Meteor LUV carbon black. The mixture was loosely packed into a refractory lined reaction vessel; a steel lined vessel would have been an adequate alternative. The mixture was ignited by forming a depression in its top surface, which was filled with fine titanium sponge, to which a flame was applied. Once ignited, an exothermic reaction propagated throughout the whole of the powder bed, such that, at a given point during the reaction the reaction mixture ahead of the reaction zone was solid, the reaction zone itself was liquid and the reacted material behind the reaction zone was solid.

Figure 4:
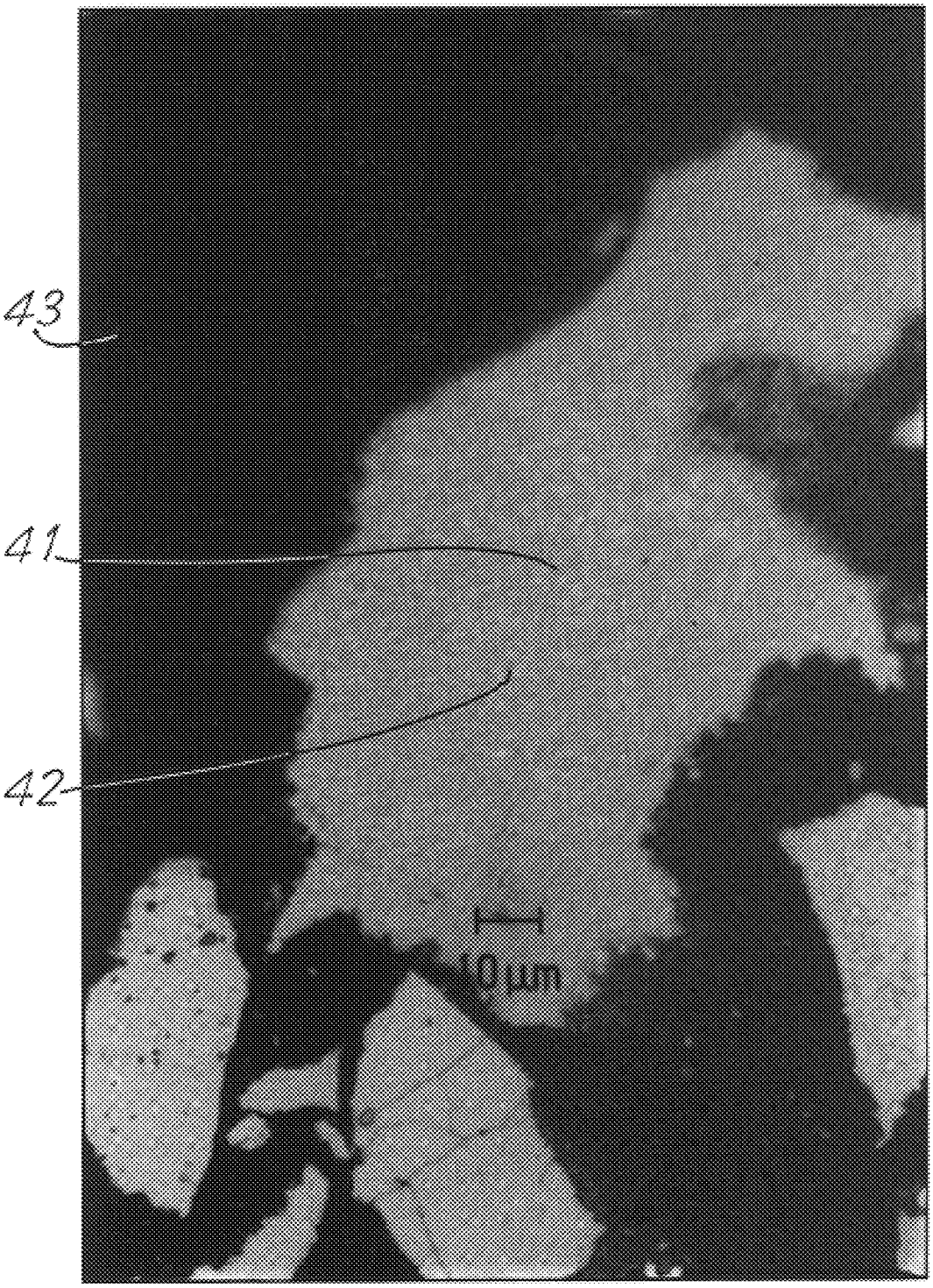
FIG. 4 shows a photomicrograph, at a magnification of 750, of the alloy produced in Example 4.

The product was allowed to cool and then crushed to a powder less than 150 microns. FIG. 4 is a photomicrograph of the product, and shows that it consists of a uniform dispersion of fine TiC grains 41 in a nickel matrix 42; the dark patches as at 43, for example, are voids. As can be readily seen, the TiC grains 41 are of globular form, and the majority are below 1 micron in size.

EXAMPLE 5

100 grams of an alloy comprising 70% titanium and 30% cobalt, by weight, were crushed to less than 500 microns in size and mixed with 16.4 grams of Meteor LUV carbon black. The mixture was loosely packed into a refractory lined reaction vessel; a steel lined vessel would have been an adequate alternative. The mixture was ignited by forming a depression in its top surface, which was filled with fine titanium sponge, to which a flame was applied. Once ignited, an exothermic reaction propagated throughout the whole of the powder bed, such that, at a given point during the reaction the reaction mixture ahead of the reaction zone was solid, the reaction zone itself was liquid and the reacted material behind the reaction zone was solid.

Figure 5:
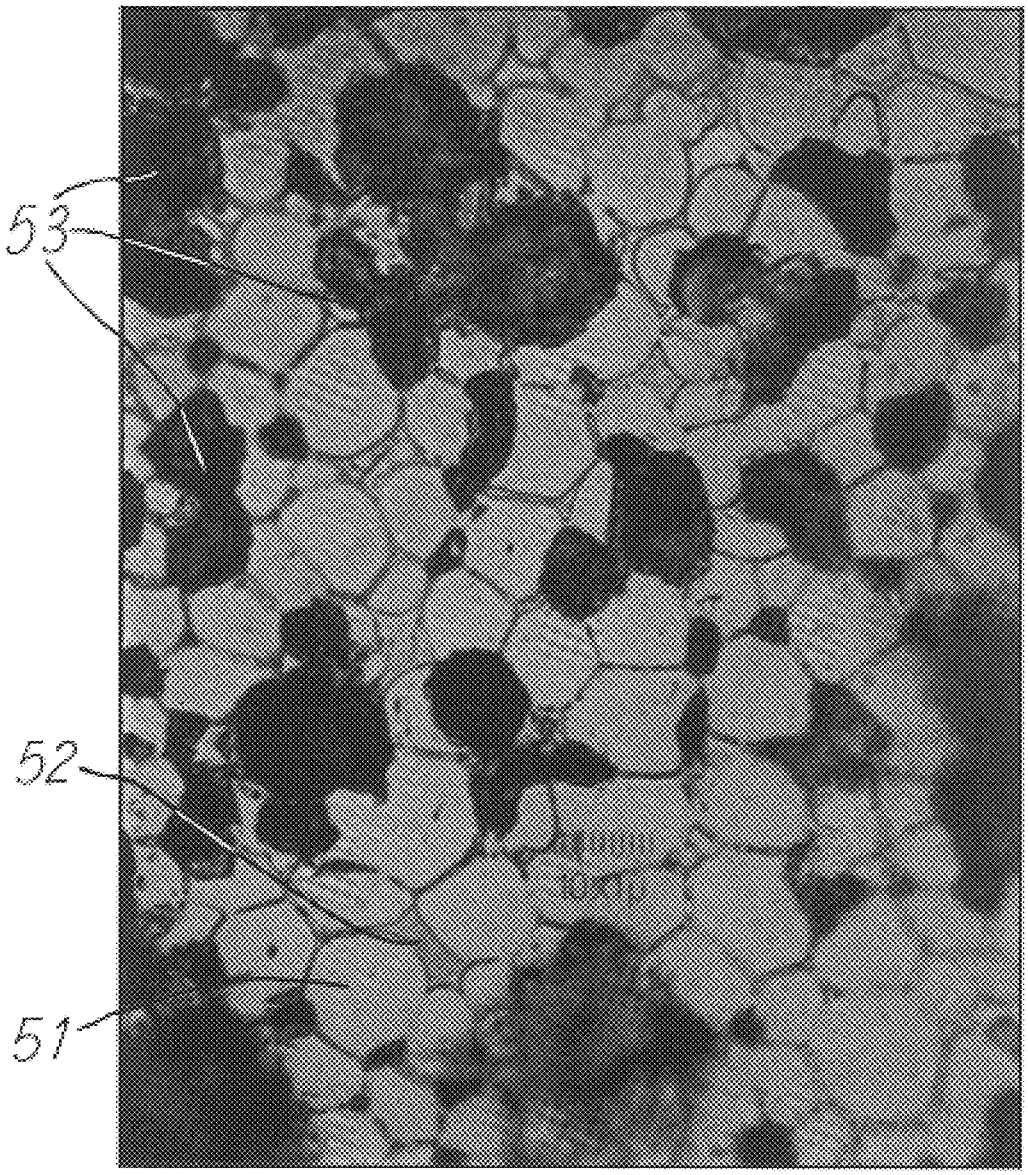
FIG. 5 shows a photomicrograph, at a magnification of 1000, of the alloy produced in Example 5.

The product was allowed to cool and then crushed to a powder less than 150 microns. Fig. 5 is a photomicrograph of the product, and shows that it consists of a uniform dispersion of fine TiC grains 51 in a cobalt matrix 52; the dark patches as at 53, for example, are areas of porosity. As can be readily seen, the TiC grains 51 are of globular form, and the majority are below 10 microns in size.

What is claimed is:

1. A method of making an alloy comprising hard particles comprising titanium carbide dispersed in a metal matrix, the method comprising firing a body of loose particulate reaction mixture comprising carbon, titanium and matrix material, wherein said firing is accomplished by applying heat to only a portion of the body of loose particulate reaction mixture so as to initiate an exothermic reaction, under conditions whereby the titanium and carbon react exothermically to form a dispersion of fine particles comprising titanium carbide in a metal matrix, said titanium being present in the reaction mixture as an alloy of matrix metal and titanium, and the body of the particulate reaction mixture is at a temperature less than 600 degrees C. immediately prior to firing.

2. A method according to claim 1, wherein the exothermic reaction is carried out under exothermic reaction conditions whereby during the reaction a molten zone moves through the body of the reaction mixture.

3. A method according to claim 1, wherein the particles comprising titanium carbide are globular in shape.

4. A method according to claim 1, wherein the average particle size of the particles comprising titanium carbide is uniform throughout the resulting dispersion.

5. A method according to claim 1, wherein the available titanium content of the reaction mixture is equal to at least 30% by weight of the total weight of the reaction mixture.

6. A method according to claim 1, wherein carbon is present in the reaction mixture as carbon black.

7. A method according to claim 1, wherein the carbon in the reaction mixture is present in an amount required to react with all of the available titanium in the reaction mixture.

8. A method according to claim 1, wherein the matrix material consists essentially of iron, and wherein the carbon in the reaction mixture is present in an amount in excess of the stoichiometric amount required to react with all of the available titanium in the reaction mixture and sufficient to react with the available iron in the reaction mixture to produce a cast iron composition.

9. A method according to claim 1, wherein the available titanium content of the reaction mixture is greater than 50% and less than 70% by weight of the total weight of the reaction mixture, wherein the carbon is present in the reaction mixture as carbon black and the carbon in the reaction mixture is present in an amount required to react with all of the available titanium in the reaction mixture, wherein the particulate reaction mixture which is fired is a loose mixture, and wherein the average particle size of the particles comprising titanium carbide is less than 25 microns and said particles are substantially uniform in size throughout the resulting dispersion.

10. A method according to claim 9, wherein titanium is present in the reaction mixture as at least one substance selected from the group consisting of ferrotitanium, an alloy comprising copper and titanium, an alloy comprising nickel and titanium, and an alloy comprising cobalt and titanium.

11. A method according to claim 10, wherein titanium is present in the reaction mixture as eutectic ferrotitanium.

12. A method according to claim 1, wherein at least one additive selected from the group consisting of tungsten, molybdenum and alloys thereof is included in the reaction mixture, whereby the density of the product alloy is increased, said additive having a density greater than the density that the product would have in the absence thereof.

13. A method according to claim 12, wherein the additive included in the reaction mixture comprises tungsten.

14. A method according to claim 13, wherein the matrix material comprises iron, and the amount of tungsten included in the reaction mixture is such that the density of the product alloy is from 6.0 to 7.9 $gcm^{-3}$.

15. A method according to claim 1, wherein the body of the particulate reaction mixture is at less than 500° C., immediately prior to firing.

16. A method according to claim 15, wherein the body of the particulate reaction mixture is at less than 100° C. immediately prior to firing.

17. A method according to claim 1, wherein the average particle size of the particles comprising titanium carbide is less than 25 microns.

18. A method according to claim 17, wherein the average particle size of the particles comprising titanium carbide is less than 10 microns.

19. A method according to claim 1, comprising firing a reaction mixture comprising carbon black and crushed eutectic ferrotitanium under exothermic reaction conditions whereby a molten zone moves through the body of the reaction mixture, to form a dispersion of globular titanium carbide particles of average particle size less than 10 microns in a ferrous metal matrix.

20. A method according to claim 1, wherein the dispersion is reduced to a powder.

21. A method according to claim 20, wherein the dispersion is reduced to a powder of average particle size less than 250 microns.

* * * * *

UNITED STATES PATENT AND TRADEMARK OFFICE

CERTIFICATE OF CORRECTION

PATENT NO. : 6,139,658
DATED : October 31, 2000
INVENTOR(S) : Davies et al.

It is certified that error appears in the above-identified patent and that said Letters Patent is hereby corrected as shown below:

Title page,
Related U.S. Application Data, change "April 17, 1997," to -- April 17, 1996, --

Column 1,
Line 4, change "April 17, 1997," to -- April 17, 1996, --
Line 21, change "ion." to -- iron. --
Line 67, change "carburisation" to -- carburization --

Column 2,
Line 18, before the ¶ beginning with "According to...", insert heading -- DESCRIPTION OF THE PREFERRED EMBODIMENTS --
Line 27, delete "DESCRIPTION OF THE PREFERRED EMBODIMENTS"
Line 54, change "practice" to -- practice) --

Column 3,
Line 6, delete "and"
Line 7, change "mixture." to -- mixture; and.--

Column 5,
Line 64, change "tests" to -- tests, --

Column 6,
Line 5, change "Example 3" to -- Example 2 --

Signed and Sealed this

Sixteenth Day of April, 2002

*Attest:*

*Attesting Officer*

JAMES E. ROGAN
*Director of the United States Patent and Trademark Office*